US005209372A

United States Patent [19]

Norwood

[11] Patent Number: 5,209,372

[45] Date of Patent: May 11, 1993

[54] COLLAPSIBLE SPIRAL CONTAINER

[76] Inventor: Peter M. Norwood, 600 Plaza Middlesex, Middletown, Conn. 06457

[21] Appl. No.: 865,061

[22] Filed: Apr. 8, 1992

[51] Int. Cl.[5] ..... B65D 1/40

[52] U.S. Cl. ..... 220/666; 220/6; 215/1 C; 215/11.3

[58] Field of Search ..... 215/1 C, 11.3; 220/666, 220/675, 669, 673, 672, 670, 6; 138/119, 122, 121; 222/215, 107, 105, 95, 92

[56] References Cited

U.S. PATENT DOCUMENTS

| | | | |
|---|---|---|---|
| 216,227 | 6/1879 | Sedgwick | 220/666 |
| 2,268,993 | 1/1942 | Sanders | 215/1 C |
| 2,833,448 | 5/1958 | Lerner | 215/1 C |
| 2,899,110 | 8/1959 | Parker | 215/1 C |
| 3,409,224 | 11/1968 | Harp et al. | 138/122 |
| 3,486,532 | 12/1969 | Sawada | 138/122 |
| 3,872,994 | 3/1975 | Hyde | 215/1 C |
| 4,245,697 | 1/1981 | Togashi | 138/121 |
| 4,456,134 | 6/1984 | Cooper | 215/1 C |
| 4,773,458 | 9/1988 | Touzani | 215/1 C |
| 4,790,686 | 12/1988 | Christ et al. | 138/122 |
| 4,802,511 | 2/1989 | Hensley | 138/122 |

FOREIGN PATENT DOCUMENTS

| | | | |
|---|---|---|---|
| 4727164 | 7/1972 | Japan | 138/121 |

*Primary Examiner*—Allan N. Shoap
*Assistant Examiner*—S. Castellano
*Attorney, Agent, or Firm*—C. G. Nessler

[57] ABSTRACT

A collapsible container has a sidewall comprised of a plurality of adjacent raised spirals defining grooves therebetween. Each spiral is comprised of a top side of a first vertical cross section plane length (width) and a shorter bottom side meeting at a fold line. When sufficient force is applied, the bottom side folds inwardly under the upper side, thus collapsing the sidewall and the container.

5 Claims, 4 Drawing Sheets

COLLAPSIBLE SPIRAL CONTAINER

FIELD OF INVENTION

The present invention relates to collapsible containers, in particular to plastic bottles for containing solids and liquids.

BACKGROUND

Collapsible containers, such as tubes and bottles, made of plastic and metal, are known. When configured as tubes, they are used for accommodating changing positions between objects, such as when a bellows connects two machine parts. When configured as bottles or cans, they are useful for containing beverages and for other purposes to which sealed containers are put.

A typical collapsible container contracts along its axial length. In beverage bottles, this will be either when partially or fully emptied. Thus, such bottles can be sized to the remaining contents, or after use they can be fully collapsed.

Lately, there has been much public attention to the problem of waste disposal, and of recycling of metal and plastic bottles and cans, in particular. Although light in weight, empty containers increase the volume of refuse. Bottles, cans, and other containers which can readily collapse will reduce volume, and thus reduce the cost for collecting and disposing of such things.

Certain patents reflect prior attempts at providing a technically and economically suitable product. U.S. Pat. No. 4,775,564 to Shriver et al. shows a collapsible container having a sidewall with a number of pleats or flutes, like a bellows. U.S. Pat. No. 4,873,100 to Dirksing et al. shows a somewhat similar appearing container, where the successive vertical rings of the container become smaller, thus facilitating the collapse. U.S. Pat. No. 4,865,211 to Hollingsworth describes a collapsible container wherein a smaller diameter base slips inside the larger diameter upper part when axial force is applied. U.S. Pat. No. 5,002,193 to Touzani shows another bellows-like container, where each peak corrugation folds at its outer edge when the collapsing force is applied. U.S. Pat. No. 4,492,313 to Touzani shows another container where each corrugation folds at its outermost peak, and where collapsing is aided by folds in the valley corrugations. U.S. Pat. No. 4,805,788 to Akiho shows a bottle with collapsible sidewall panels. U.S. Pat. No. 4,492,313 to Touzani shows a circular bellows-like sidewall, where the bottom portion of each ring folds under the upper portion when the container is collapsed. U.S. Pat No. 4,790,361 to Jones et al. describes a bottle having corrugations comprised of a multiplicity of polygonal planes.

The prior art indicates that a lot of effort has been applied to making collapsible containers. Still, there is continuing need for improvements in the design and manner of collapse, to provide containers which are dimensionally stable and strong when filled and which are readily collapsible to compact stable shapes.

SUMMARY OF THE INVENTION

An object of the invention is to provide containers which are strong and stable when in use, but which readily fold to compact stable shapes when emptied, to thereby reduce the volume of the containers. A further object is to provide a container which has sidewall configuration as near as possible to conventional non-collapsible bottles; and to have the containers fabricable by conventional molding techniques.

In accord with the invention, a cylindrical container has a collapsible sidewall comprised of two or more raised spirals, joined together at a groove, running from the top to the bottom of the container. At the bottom of the groove is a fold line. Each spiral is comprised of a top side and a bottom side, joined at a fold line along the outermost part of the spiral; the top side faces upwardly while the bottom side faces downwardly. The bottom side is shorter in vertical cross section plane length than the top side. When longtitudinal or appropriate rotational force is applied to the container, the bottom side folds inwardly under the top side and the spirals, and hence, the sidewall collapses axially.

Containers may have combinations of open and closed top and bottom and may be made of different materials. The container presents a pleasing appearance and it can be readily made by common plastic bottle molding. When the sidewall collapses, a substantial change in vertical height occurs, thus fulfilling the objects of the invention.

The foregoing and other objects, features and advantages of the invention will become more apparent from the following description of the best mode of the invention and accompanying drawings.

DESCRIPTION OF THE PREFERRED EMBODIMENT

Figure 1:
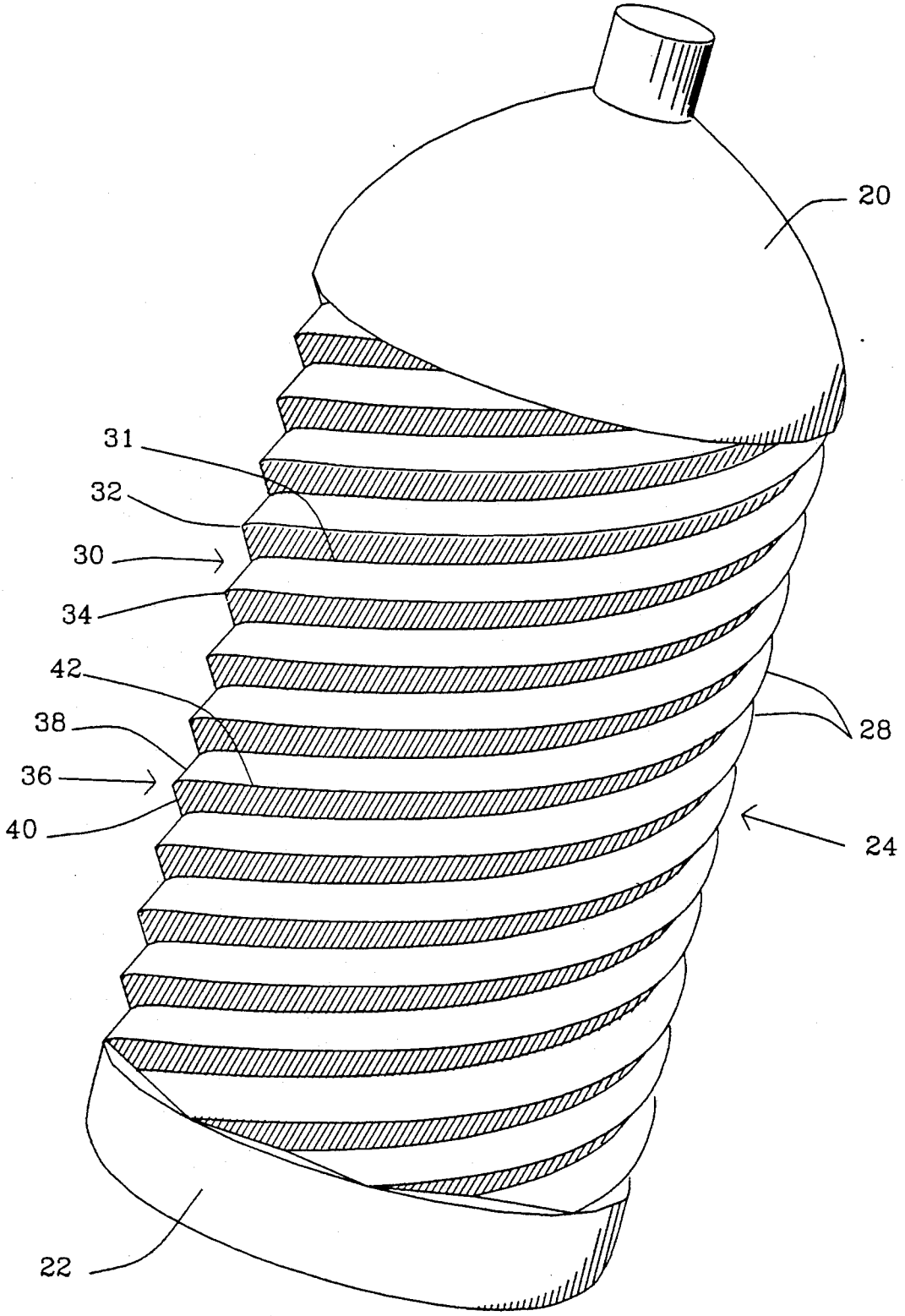
FIG. 1 is an axiometric view of a bottle having a eight spirals running along the sidewall.
Figure 2:
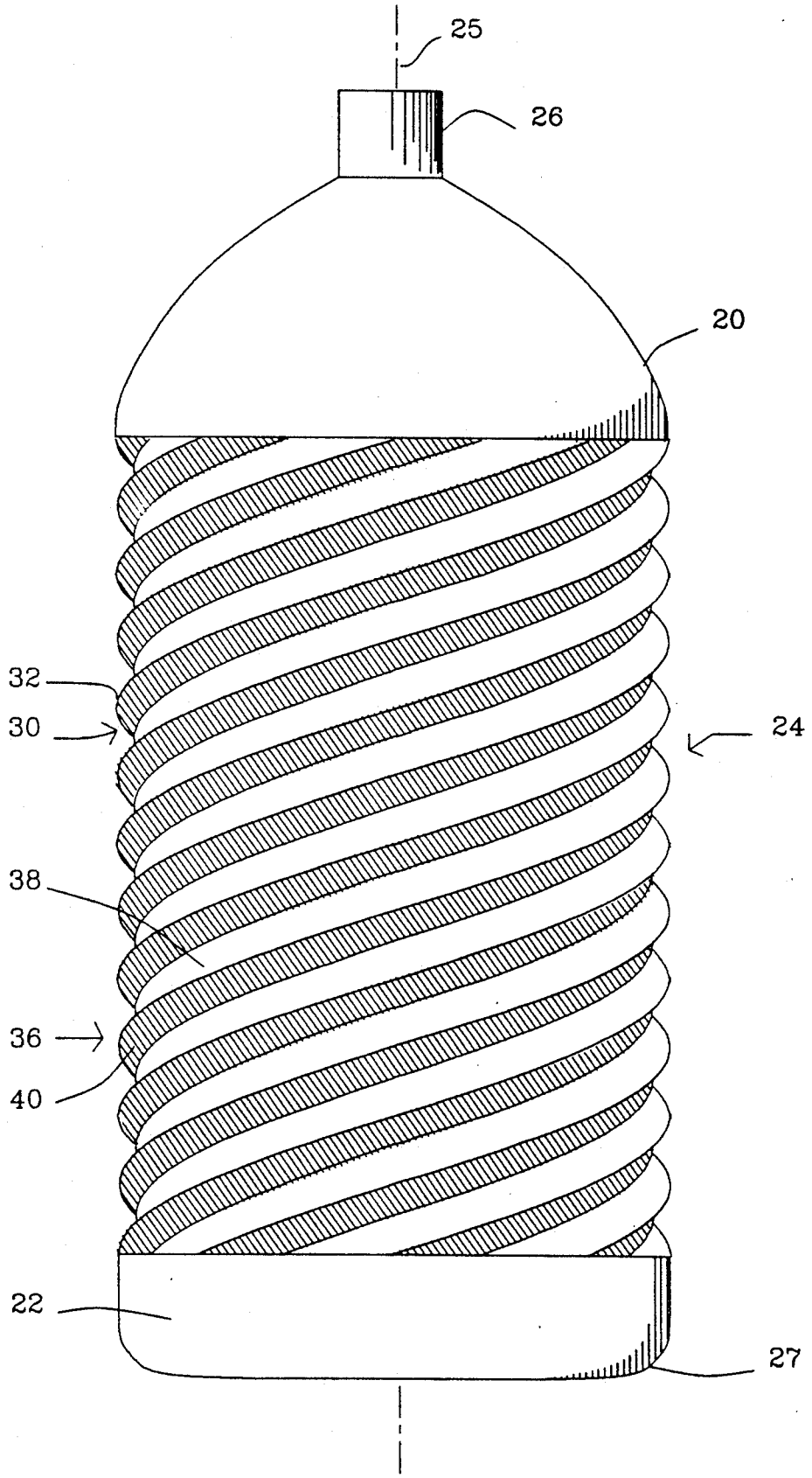
FIG. 2 is an elevation view of the bottle of FIG. 1.
Figure 3:
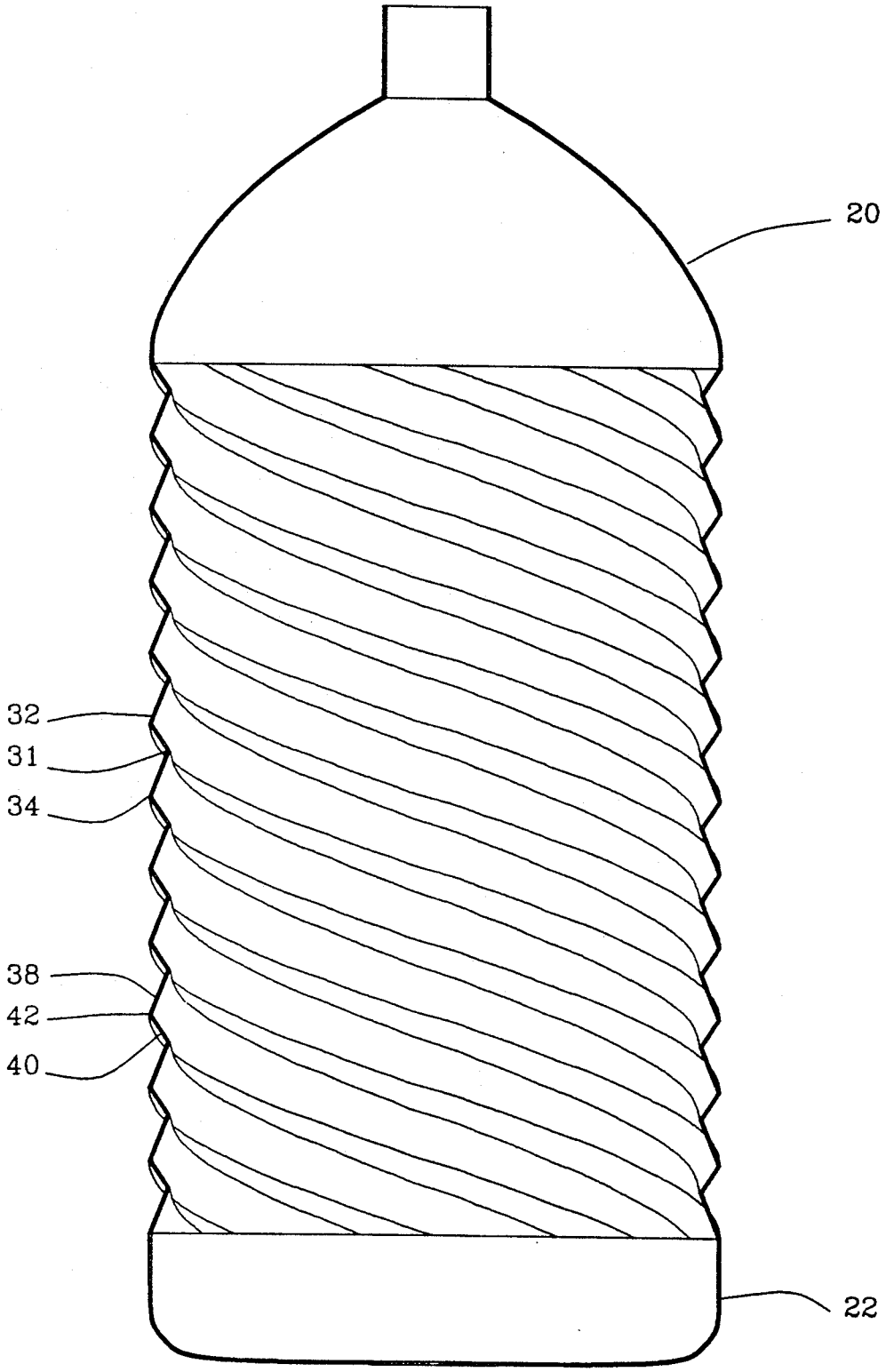
FIG. 3 is a centerline cross section of the bottle of FIG. 2.

The preferred embodiment is described in terms of a molded plastic bottle. FIG. 1, 2 and 3 show a bottle having a top 20 and spaced apart bottom 22, connected by sidewall 24, all lying along a longtitudinal axis 25. The top has a neck 26, suitable for a closure. The bottom is cylindrical with a curved edge 27. There are a multiplicity of spirals running in parallel fashion from the bottom to the top of the sidewall.

The bottle has eight raised spirals 28, each running one and one half turns from the bottom to the top. Adjacent spiral pairs form grooves, e.g, spirals 32, 34 form a groove 30 at the bottom of which is a fold line 31. Typical spiral 36 has an upper side 38 and a lower side 40 joined together at the fold line 42 at the diametrically outermost portion of the spiral. As the transverse cross section of FIG. 3 shows, the top and bottom sides are straight in the vertical plane. However, they may also be curved in shape, e.g., like a hyperbola. The upper side 38 has a steeper angle with the vertical, or the longitudinal axis, than does the lower side. The bottom side 40 of the typical spiral is shorter in vertical cross section plane length (that is, width, if viewed as traveling along the spiral path) than is the top side 38. From the FIG. 3 cross section plane the relation between the upper side and lower side is seen to be about 1 to 1.5.

Figure 4:
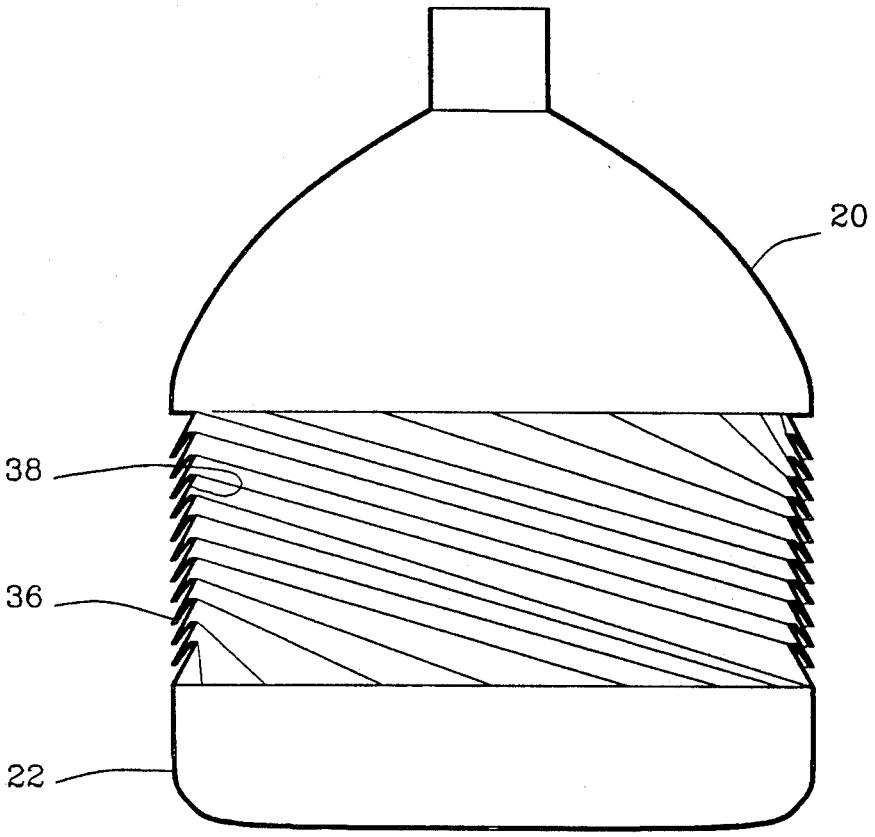
FIG. 4 is a centerline cross section of the bottle of FIGS. 1–3, showing it in the collapsed state.

When axial force, or suitable direction rotational force, is applied to the top of the bottle, the spirals will collapse, with the bottom sides buckling and folding inwardly under the upper sides on each spiral. This is illustrated by the FIG. 4 cross section showing the bottle of FIG. 3 in the collapsed state. The shorter lower sides are shown to have folded under the upper sides and to have become angled downwardly, oppositely to the way they were before the collapse. Each collapsed spiral is nested under the one above.

The angle, or pitch, of the spirals may be varied. Different numbers of spirals may be used, with numbers like 4, 6, 8 and 12 being in contemplation. At the bottom and top, the spirals will be evenly spaced apart, and thus each spiral will start at a point 360/n degrees apart, where n is the number of spirals. For example, if there are 6 spirals, they will each start at 360/6 degree, or 60 degree, or circumferential arc increments around the base or top.

The angles of the sides with the vertical may be varied. Choice may depend on the plastic formulation which is used. So, too, the vertical plane length of the spiral sides may be varied. Choice of parameters can change how the container respondes to the collapsing load. To make the bottle exterior surface more suitable for advertising, shallow angles of the sides with the vertical are preferred.

An ordinary container has a narrow neck top like that shown in the Figures here. In other embodiments, it may have an open top and bottom or combinations of open and closed top and bottom. The container is preferably made of plastic of common type, but it can be made of metals and composites as well.

Although only the preferred embodiment has been described with some alternatives, it will be understood that further changes in form and detail may be made without departing from the spirit and scope of the claimed invention.

What is claimed is:

1. A collapsible container having a top and a bottom spaced apart along a longitudinal axis, connected by a generally cylindrical sidewall;

the sidewall having a plurality of raised, adjacent spirals running from the bottom to the top, the adjacent spirals joined together and defining a groove therebetween;

each spiral comprised of a top side and a bottom side joined at a fold line at the diametrically outermost part of the spiral;

the spiral top side facing upwardly toward the top of the container, having a first vertical cross section plane length;

the spiral bottom side facing downwardly toward the bottom of the container, having a second vertical cross section plane length less than said first vertical cross section plane length;

wherein each bottom side of each spiral folds inwardly under the top side of each said spiral when force is applied longitudinally or rotationally to the container top and bottom, to thereby collapse the spiral and shorten the length of the sidewall.

2. The container of claim 1 wherein the top side has a lesser angle with the longitudinal axis than does the bottom side.

3. The container of claim 1 characterized by the top and bottom being open.

4. The container of claim 1 characterized by the top and bottom being closed.

5. The container of claim 1 made of plastic.

* * * * *